US005355416A

United States Patent [19]

Sacks

[11] Patent Number: 5,355,416

[45] Date of Patent: Oct. 11, 1994

[54] PSYCHO ACOUSTIC PSEUDO-STEREO FOLD BACK SYSTEM

[75] Inventor: Bill Sacks, Arlington, Va.

[73] Assignee: Circuits Maximus Company, Inc., Columbia, Md.

[21] Appl. No.: 60,697

[22] Filed: May 13, 1993

Related U.S. Application Data

[63] Continuation of Ser. No. 695,453, May 3, 1991, abandoned.

[51] Int. Cl.[5] ..... H04S 5/00

[52] U.S. Cl. ..... 381/17; 381/25; 381/74

[58] Field of Search ..... 381/25, 17, 1, 74

[56] References Cited

U.S. PATENT DOCUMENTS

| | | | |
|---|---|---|---|
| 2,827,514 | 3/1958 | Murray . | |
| 2,942,070 | 6/1960 | Hammond . | |
| 2,978,543 | 4/1961 | Kennedy . | |
| 3,124,649 | 3/1964 | Pflager . | |
| 3,219,757 | 11/1965 | Palladino . | |
| 3,322,899 | 5/1967 | Renwick . | |
| 3,670,106 | 6/1972 | Orban . | |
| 3,790,711 | 2/1974 | Ojima et al. . | |
| 4,359,605 | 11/1982 | Haramoto . | |
| 4,412,106 | 10/1983 | Pavel | 381/25 |
| 4,503,554 | 3/1985 | Davis | 381/1 |
| 4,635,288 | 1/1987 | Stadius | 381/119 |
| 4,783,814 | 11/1988 | Foley | 381/25 |
| 4,833,715 | 5/1989 | Sakai . | |
| 4,873,722 | 10/1989 | Tominari . | |
| 4,908,858 | 3/1990 | Ohno | 381/1 |
| 4,910,778 | 3/1990 | Barton | 381/1 |
| 5,056,149 | 10/1991 | Broadie | 381/17 |
| 5,208,860 | 5/1993 | Lowe et al. | 381/17 |

FOREIGN PATENT DOCUMENTS

| | | | |
|---|---|---|---|
| 2554657 | 5/1985 | France | 455/89 |

*Primary Examiner*—Forester W. Isen
*Attorney, Agent, or Firm*—Daniel R. Gropper

[57] ABSTRACT

This invention teaches a method of mixing sound so that a monophonic common ambience audio channel, derived either from a mix of an entire performance, or from a specially created audio mix, is folded back to an individual performer's earphones together with a fold-back of that individual performer's microphone or electronic instrument pickup audio signal. The individual performer's microphone or electronic instrument pickup audio is fed to both of a performer's earphones in polarity, while the ambiance mix is fed, simultaneously with the performer's microphone or electronic instrument pickup mix, to both of a performer's earphones, out of polarity, thereby creating a psycho acoustic pseudo stereo effect so that the performer perceives the monophonic ambiance mix as a wide spacious stereophonic field from behind the performer with no specific ability to place an instrument at a specific place in the field.

23 Claims, 3 Drawing Sheets

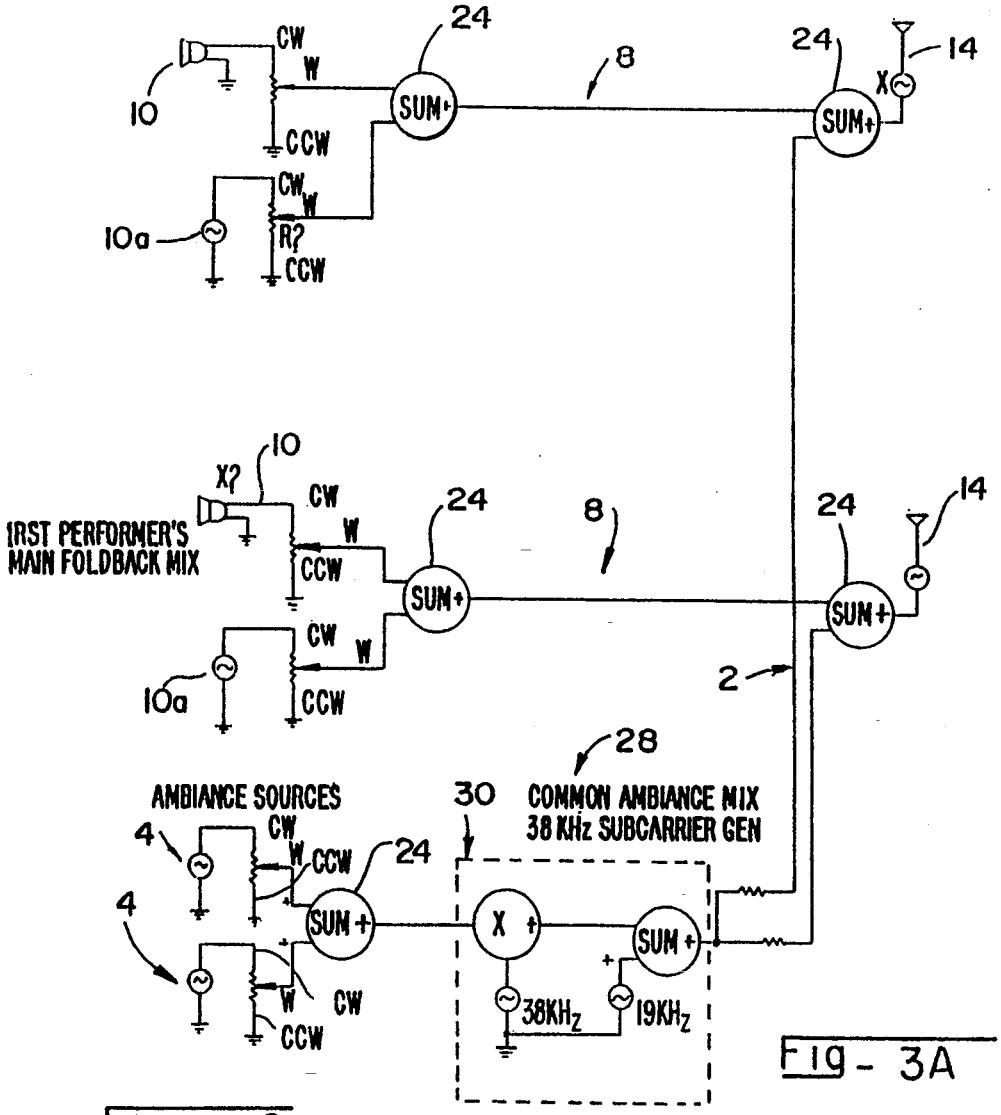
Fig- 3A
Fig- 3C
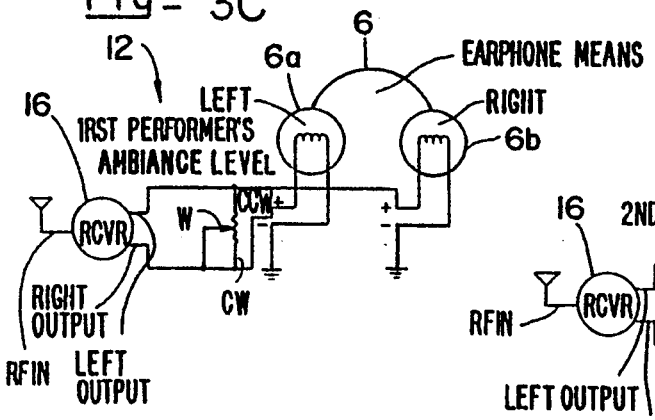
Fig- 3B
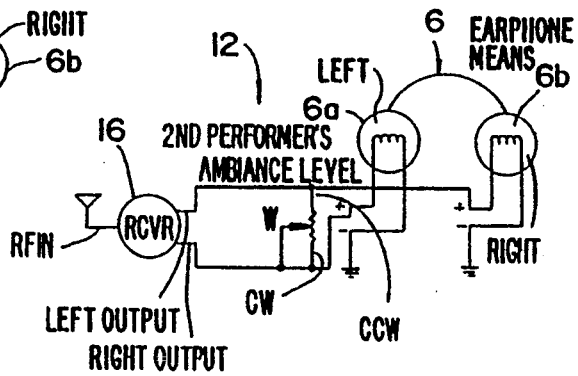

PSYCHO ACOUSTIC PSEUDO-STEREO FOLD BACK SYSTEM

This is a continuation of co-pending application Ser. No. 07/695,453, filed May 3, 1991, now abandoned.

1. BRIEF SUMMARY OF THE INVENTION

This invention teaches a method of mixing sound so that a monophonic common ambience audio channel, derived either from a mix of an entire performance, or from a specially created audio mix, is folded back to an individual performer's earphones together with a foldback of that individual performer's microphone or electronic instrument pickup audio signal. The individual performer's microphone or electronic instrument pickup audio is fed to both of a performer's earphones in polarity, while the ambiance mix is fed, simultaneously with the performer's microphone or electronic instrument pickup mix, to both of a performer's earphones, out of polarity, thereby creating a psycho acoustic pseudo stereo effect so that the performer perceives the monophonic ambiance mix as a wide spacious stereophonic field from behind the performer with no specific ability to place an instrument at a specific place in the field. The performer perceives his/her microphone or electronic instrument pickup mix in the center of the performer's sound field. The performer has the ability to control the relative level of ambiance mix to performer foldback. The net effect is a mix customized to the performer's individual needs without the perceived disadvantages of straight mono earphone foldback being "too close in" and without the time effort and equipment needed to create conventional true stereo for each individual monitor mix.

The link between the performer and the main or ambiance information may be by any conventionally known or future created technologies such as by hard wire, radio, infra-red, fiber optics, laser etc., or any combinations thereof. Conventional stereo and other audio information contained on numerous subcarriers may be used simultaneously with the above described methods. Multiple separate main channels may be used along with one or more common ambiance subchannels of audio information bussed and interconnected to each of the multiple main channel stereo transmitters.

2. FIELD AND BACKGROUND OF THE INVENTION

Monitors are used so that performers can hear themselves while performing to be able to know how well they are working the microphones and to be able to adjust their pitch and intonation during a performance. Mono earphone monitors tend not to be preferred by performers as the resulting sound is "too close" and inside the performer's head. Monitor mixes are difficult to do in stereo because of the many problems encountered by the sound mixing engineer in trying to create live stereo monitor mixes while maintaining an evenly balanced stereo image. This task becomes more complicated as the number of performers and requested special effects for individual performers grows.

If a signal comes out of only one channel, it is placed squarely on that channel, hard right or hard left. If the signal comes out of both of channels equally, it sounds as if it is in the center. If a signal comes out of the channels equally but with the driven elements out of polarity with respect to each other, it sounds as though it is coming from a wide space behind the performer. This is the psycho acoustic pseudo stereo effect.

This psycho acoustic pseudo stereo effect is known in the art and has been described in many patents including U.S. Pat. Nos. 4,068,093; U.S. Pat. No. Re. 25,652 and U.S. Pat. No. 3,924,072.

3. SUMMARY OF THE INVENTION

An object of the present invention is to provide a method of mixing sound so that a monophonic common ambience audio channel, derived either from a mix of an entire performance, or from a specially created audio mix, is folded back to an individual performer's earphones together with a foldback of that individual performer's audio wherein the individual performer's audio is fed to both of a performer's earphones in polarity, while the ambiance mix is fed, simultaneously with the performer's mix, out of polarity, thereby creating a psycho acoustic pseudo stereo effect with the performer perceiving him or herself in the center of the stereo sound.

Another object of the present invention is to provide the performer with the ability to control the relative level of ambiance mix to performer foldback thereby giving the performer the ability to adjust his mix to his own specifications thereby reducing the amount of attention required to create and maintain multiple and special mixes on stage.

Another object of the present invention is to permit conventional true stereo special effects, such as from a prerecorded source, to be used along with psycho acoustic pseudo stereo.

Another object of the present invention is to process the dynamic range ambiance subcarrier channel for greater density to reduce apparent noise by masking to make the ultimate mix with the main channel, which may or may not also need to be processed, a more pleasing and useful mix.

4. BRIEF DESCRIPTION OF THE DRAWINGS

FIGS. 3A–3C is a block diagram of a generic interface, such as via radio, psycho-acoustic pseudo stereo foldback system showing two main foldback mixes, a common ambiance audio mix and two performer outputs.

5. DESCRIPTION OF THE PREFERRED EMBODIMENTS

Figure 1:
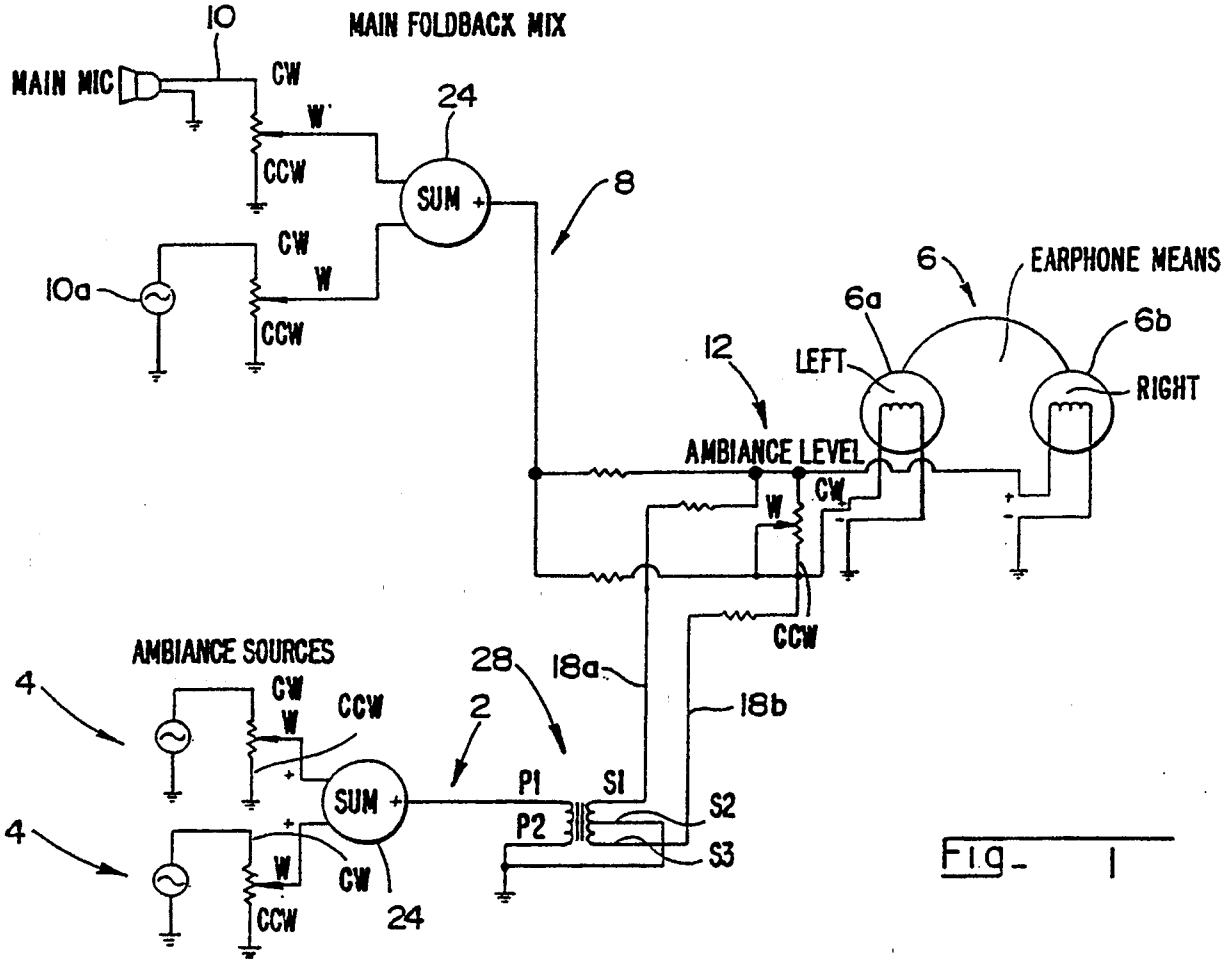
FIG. 1 is a block diagram of a hard wire psycho-acoustic pseudo stereo foldback system showing a main foldback mix, a common ambiance audio mix and one performer output.

Referring generally to FIG. 1, this invention relates to a method of mixing sound so that a monophonic common ambience audio channel 2, derived either from a mix of an entire performance, or from a specially created audio mix, generally 4, is folded back to an individual performer's earphones 6 together with a foldback of that individual performer's audio, generally 8. The individual performer's audio 8 is fed to both of a performer's earphones, *6a*, *6b* in polarity, while the ambiance mix 2 is fed, simultaneously with the performer's mix 8, out of polarity, thereby creating a psycho acoustic pseudo stereo effect, with the performer's mic 10 or instrument pickup mix 10*a* placed in the center of the performer's sound field as perceived in the performer's earphones 6.

The performer has the ability to control the relative level of ambiance mix 2 to performer foldback 8 by using a simple blend control 12. The net effect is a mix customized by the performer to the performer's individual needs with a minimum of circuit complexity.

Although a number of conveyance modes, presently known or to be invented in the future, can be used to convey the main and ambiance channel to the performer, two presently known and preferred methods are described herein. Multiple conveyance modes may be used simultaneously in one system.

A. HARD WIRED AND OTHER TRANSMISSION MEANS

Figure 2:
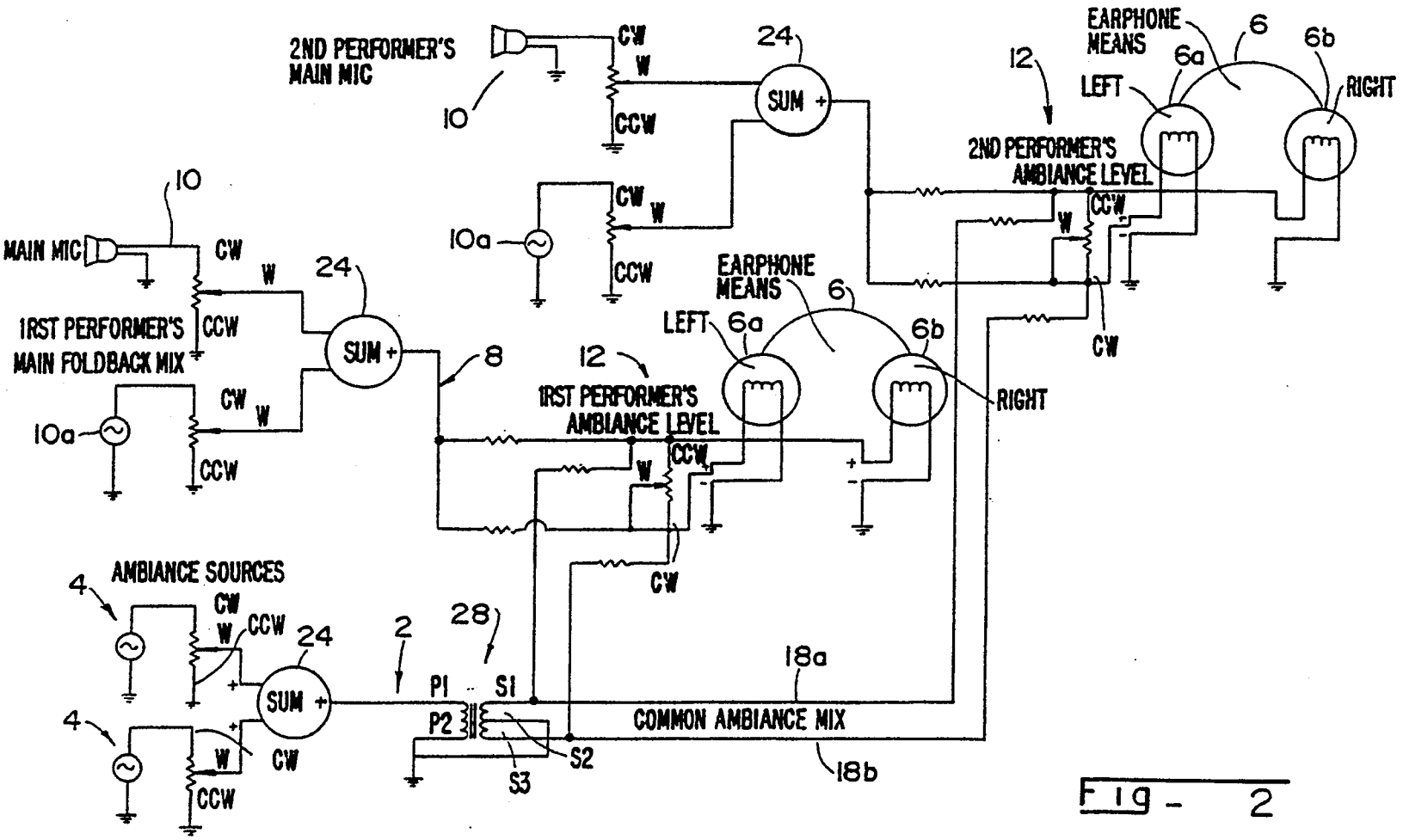
FIG. 2 is a block diagram of a hard wire psycho-acoustic pseudo stereo foldback system showing two main foldback mixes, a common ambiance audio mix and two performer outputs.

FIG. 2 shows a multiperformer psycho acoustic pseudo stereo hard wire foldback system. For clarity, components operating in a similar manner for each performer are given the same number. It will be understood that the system is virtually expandable for any number of performers without substantial change. Each performer hears a foldback of its own performer mix 8 in addition to the ambiance mix 2. The common ambiance mix 2 is bussed to all performers by various means.

FIG. 2 shows a balanced or differential wire bus 18*a*, 18*b* containing the ambiance mix 2 connected to each performer's earphones 6*a*, 6*b*. Each performer will receive a local sidetone of his own microphone 10 or electronic instrument pickup 10*a* as well as a feed from a differential wire bus 18*a*, 18*b*, the signals of which will be out of polarity with respect to one another. The resulting psycho acoustic effect being perceived by each performer in his earphones 6. The performer may add other sound effects 10*a* to taste such as local reverberation etc.

Out of polarity information may be made available to each performer by means of various presently known, or invented in the future, transmission technologies such as infra-red or magnetic loop etc., shown generically as differential means 28.

It will be understood that any combination of hard wire and various other types of transmission technology may be used in the same network system depending on the needs of the venue and the performers.

B. FM Wireless Method

FIGS. 3A–3C shows a simplified diagram of an FM radio link multi performer embodiment conveying the monophonic common ambiance channel audio information 2 and the individual performer's audio 8 to the performer's earphones 6*a*, 6*b* through use of an FM multiplex transmitter 14 and an FM multiplex receiver 16.

It is common to have a biphonic two channel stereo baseband, created by a subcarrier generator, shown generally at 30, in the following configuration: main channel (L+R) located at 0–15 kHz; a pilot signal at 19 kHz; and a double (upper and lower) sideband (L−R) centered on 38 kHz. If the received signal level drops significantly, the (L−R) drops and the (L+R), the strongest and quietest part of the baseband remains. Since the performer's own audio signal 8 appears on the 0–15 kHz baseband, the system will continue to operate with only the performer's signal 8, albeit without the ambiance channel 2 or other special effects contained on other subcarriers, until the radio again begins to receive the subcarriers after the interruption. Circuitry to automatically reduce the decoded subcarrier output in weak signal strength conditions is common and well known in the art.

FM stereo transmitters 14 and receivers 16 are well known in the industry. These units encompass traditional stereo matrixing methods employing a main channel Left plus Right (L+R) and at least one other subcarrier Left minus Right (L−R). When audio signals are encoded in the disclosed format and are transmitted to a standard stereo receiver, the receiver main channel 8 output is fed in equal amplitude and in polarity to each earphone, 6*a*, 6*b* while the 38 kHz subcarrier (the ambiance mix 2) is decoded and fed in equal amplitude and 180° out of polarity with respect to one earphone 6*a*, 6*b* to another. Both main channel 8 and ambiance channel 2 information is simultaneously received by the performer's earphones 6*a*, 6*b* thereby reproducing the original psycho acoustic pseudo stereo signal.

The decoded subcarrier audio is noisier than the main baseband information. Since the ambiance mix 2 tends to be a denser mix because it contains the entire performance, it tends to have a higher average sound level so the noise is effectively masked. Additionally, during noisy conditions, either automatically or manually through use of the blend control 12, the level of the ambience channel 2, with reference to the main channel 8, can be decreased to decrease the apparent overall perceived noise in the receiver thereby resulting in a cleaner, higher fidelity signal. Finally, the ambiance channel 2 can be independently compressed and automatic gain control functions can be utilized without having to also process the performer's signal on the main channel 8. Processing further increases the density and reduces or eliminates background noise by masking it. Many performers find dynamic range reduction devices operating on their main foldback mix 8 annoying and objectionable. It has been found that the performer will not so much be bothered by the processing of the common ambiance mix 2 because it is primarily background information. Performers find dynamic range processing objectionable on their own main channel 8 because they are the source of the signal and therefore have a point of reference which causes the processing artifacts to become objectionably apparent.

A blend control 12 is placed on the receiver to permit the performer to adjust the mix of the main 8 and ambiance 2 channels to modify their mix as desired by the performer or even to completely eliminate the entire ambiance channel 2 thereby creating a mono or solo format of their own foldback in its simplest form.

It is possible, and often desirable, to place multiple main channels 8 of multiple performers on different frequencies separated by perhaps 1 Mhz each and to maintain one common ambiance channel 2, perhaps generated by one subcarrier generator/modulator and transmitted to all of the individual performers. This becomes even more valuable as the number of performers at a venue increase as the actual mixes of main 8 and ambiance 2 are adjusted or blended by means of blend controls 12 etc. by each performer and one ambiance mix 2 provides pseudo stereo for all of the performers. This dramatically simplifies the monitor engineer's tasks by permitting each individual performer to adjust and fine tune his own main channel 8 to ambiance channel 2 mix to create his own psycho acoustic environment.

Additionally,the receivers and or the transmitted mix can be set up to accommodate spatial effects such as taking a small amount of ambiance audio 2 and feeding it, with the desired phasing amplitude relationship, to the main channel 8 of that individual performer or visa versa.

Additional signals can be inserted into the main 8 and ambiance 2 mixes at their respective input points for special effects.

As necessary, mixing and blending may take place before these signals enter the network generally shown as mixing points 24. Conventional stereo can be overlayed onto the pseudo stereo mix by applying true stereo that has been continually matrixed into (L+R) information into the main channel 8 together with the performer's signal and left minus right matrixed stereo (L−R) information into the ambiance channel 2 on top of the pseudo stereo information. This is done for true stereo special effect tracks such as the sound of a passing train which may be part of the original score.

The disclosed system can also have an auxiliary pseudo stereo mono compatible output continuously derived from the main 8 and ambiance mixes 2 for mass media conveyances such as FM broadcast which require monophonic compatibility. Such pseudo stereo techniques have been disclosed, for example, by U.S. Pat. No. 3,670,106 to Orban. The system disclosed herein makes use of main 8 and ambiance 2 monaural mixes of information as described above. Mono compatible pseudo stereo recordings may be made from a secondary output of the main 8 and ambiance 2 mixes when the main 8 and/or ambiance 2 channels are processed through an Orban synthesizer. Alternately, the ambiance channel 2 can be fed through the Orban synthesizer and recombined with the main channel 8 of information which remains in the center of the sound field. This may be accomplished without interfering with the psycho acoustic pseudo stereo methods taught herein.

While specific embodiments of the invention have been shown and described in detail to illustrate the application of the principles of the invention, it will be understood that the invention may be embodied otherwise without departing from such principles.

I claim:

1. A Psycho-Acoustic Pseudo Stereo System comprising:

(a) at least one main channel of mono acoustic information;

(b) at least one ambiance channel of mono acoustic information, wherein said ambiance channel of mono acoustic information primarily contains mono acoustic information different from the mono acoustic information contained on said main channel of acoustic information;

(c) earphone means having at least two transducers;

(d) means for feeding said main channel with the same polarity and no delay to each said earphone transducer;

(e) means for feeding, simultaneously with said main channel, said ambience channel in respective opposite polarities and no delay to respective transducers; and, (f) means for adjusting the relative amplitude levels between said main channel of mono acoustic information and said ambiance channel of mono acoustic information;

(g) wherein, said main channel of mono acoustic information is perceived through said earphone means to be front and center with respect to said ambiance channel of mono acoustic information which is perceived to be a wide spacious field surrounding said main channel of mono acoustic information.

2. A Psycho-Acoustic Pseudo Stereo System, as recited in claim 1, wherein said means for feeding further comprises a radio link between said transducers and said main channel of acoustic information.

3. A Psycho-Acoustic Pseudo Stereo System, as recited in claim 1, wherein said means for feeding further comprises a radio link between said transducers and said ambiance channel of acoustic information.

4. A Psycho-Acoustic Pseudo Stereo System, as recited in claim 2, wherein said radio link is Frequency Modulated.

5. A Psycho-Acoustic Pseudo Stereo System, as recited in claim 3, wherein said radio link is Frequency Modulated.

6. A Psycho-Acoustic Pseudo Stereo System, as recited in claim 4, wherein said radio link is in a multiplexed subcarrier stereo configuration.

7. A Psycho-Acoustic Pseudo Stereo System, as recited in claim 5, wherein said radio link is in a multiplexed subcarrier stereo configuration.

8. A Psycho-Acoustic Pseudo Stereo System, as recited in claim 6, wherein said radio link further comprises a stereo radio transmitter and a stereo radio receiver.

9. A Psycho-Acoustic Pseudo Stereo System, as recited in claim 7, wherein said radio link further comprises a stereo radio transmitter and a stereo radio receiver.

10. A Psycho-Acoustic Pseudo Stereo System, as recited in claim 8, wherein said main channel is transmitted and received on the main channel of the stereo baseband and wherein said ambiance channel is transmitted and received on a subchannel of the stereo baseband.

11. A Psycho-Acoustic Pseudo Stereo System, as recited in claim 9, wherein said main channel is transmitted and received on the main channel of the stereo baseband and wherein said ambiance channel is transmitted and received on a subchannel of the stereo baseband.

12. A Psycho-Acoustic Pseudo Stereo System, as recited in claim 10, further comprising means for the performer to adjust the mix of said main and said ambiance channels at the receiver.

13. A Psycho-Acoustic Pseudo Stereo System, as recited in claim 11, further comprising means for the performer to adjust the mix of said main and said ambiance channels at the receiver.

14. A Psycho-Acoustic Pseudo Stereo System, as recited in claim 10, further comprising means for overlaying audio information contained on more than one subcarrier over said main and said ambiance channels.

15. A Psycho-Acoustic Pseudo Stereo System, as recited in claim 11, further comprising means for overlaying audio information contained on more than one subcarrier over said main and said ambiance channels.

16. A Psycho-Acoustic Pseudo Stereo System, as recited in claim 1, further comprising means for overlaying conventional stereo information over said main and said ambiance channels.

17. A Psycho-Acoustic Pseudo Stereo System, as recited in claim 1, further comprising means for overlaying special audio effects over said main and said ambiance channels.

18. A Psycho-Acoustic Pseudo Stereo System, as recited in claim 2, further comprising multiple channel radio links for conveying said main channel of acoustic information.

19. A Psycho-Acoustic Pseudo Stereo System, as recited in claim 18, further comprising a single subcarrier modulator for the ambiance channel whose audio information is distributed to each of said multiple channel radio links for use as the common subcarrier along with each individual main channel of information.

20. A Psycho-Acoustic Pseudo Stereo System, as recited in claim 1, further comprising:

(a) means for processing said ambiance channel of acoustic information in a mono compatible pseudo stereo format; and, (b) means for combining said processed said ambiance channel of acoustic information in a mono compatible pseudo stereo format with said main channel of acoustic information thereby providing a pseudo stereo feed for conventional stereo equipment where mono compatibility must be maintained.

21. A Psycho-Acoustic Pseudo Stereo System, as recited in claim 1, wherein said main channel of acoustic information is processed to reduce noise.

22. A Psycho-Acoustic Pseudo Stereo System, as recited in claim 1, wherein said ambiance channel of acoustic information is processed to reduce noise.

23. A Psycho-Acoustic Pseudo Stereo System comprising:

(a) a plurality of individual main channels of acoustic information (b) an ambiance channel of acoustic information, wherein said ambiance channel of acoustic information is derived from at least one source of sound different from the source of sound of said main channel of acoustic information;

(c) a plurality of earphone means, each having at least two transducers;

(d) means for feeding each said individual main channel with the same polarity to each said earphone transducer of a respective one of said earphone means;

(e) means for feeding, simultaneously with each said individual main channel, said ambiance channel in respective opposite polarities to each said earphone transducer of said respective one of said earphone means;

(f) wherein said means for feeding further comprises multiple channel radio links, each radio link connecting a respective one of said individual main channels of acoustic information with a respective one of said earphone means; and, (h) wherein said means for feeding further comprises a single subcarrier modulator for the ambiance channel whose audio information is distributed to each of said multiple channel radio links for use as a common subcarrier along with each individual said main channel of information.

* * * * *